US005110079A

United States Patent [19]

Evenson et al.

[11] Patent Number: 5,110,079

[45] Date of Patent: May 5, 1992

[54] DETACHABLE PERSONAL ACCESSORY APPARATUS FOR USE WITH PANEL SYSTEMS

[75] Inventors: Mel Evenson, San Pedro; John Melzian, Rancho Palos Verdes, both of Calif.

[73] Assignee: Rubbermaid Office Products Group, Inc., Inglewood, Calif.

[21] Appl. No.: 708,743

[22] Filed: May 31, 1991

[51] Int. Cl.[5] ..... A47B 96/06

[52] U.S. Cl. ..... 248/222.1; 211/105.1; 248/225.2

[58] Field of Search ..... 248/222.1, 225.1, 225.2, 248/231.4; 224/311, 313, 42.45 A; 211/123, 105.1, 105.3, 105.4; 223/85

[56] References Cited

U.S. PATENT DOCUMENTS

| | | | |
|---|---|---|---|
| 2,728,503 | 12/1955 | Kramer | 224/42.45 A |
| 3,591,117 | 7/1971 | Mazzetti | 248/231.4 X |
| 3,620,376 | 11/1971 | Gingher | 211/123 |
| 3,981,404 | 9/1976 | Goeke | 211/105.3 X |
| 4,316,547 | 2/1982 | Varon | 211/105.1 |
| 4,852,839 | 8/1989 | Winter | 248/225.1 |
| 4,932,539 | 6/1990 | Adinanti | 211/123 |
| 5,026,014 | 6/1991 | Korth | 248/225.2 |

FOREIGN PATENT DOCUMENTS

| | | | |
|---|---|---|---|
| 43935 | 6/1972 | Australia | 248/225.2 |

*Primary Examiner*—J. Franklin Foss

*Attorney, Agent, or Firm*—Price, Gess & Ubell

[57] ABSTRACT

An personal accessory holder that is adapted to be demountably affixed to an existing upright standard. The personal accessory holder of the preferred embodiment essentially includes an elongated cylindrical body having an adjustable fastener apparatus for mounting the body to the upright standard. A channel is disposed through the cylindrical body, parallel to the longitudinal axis. The channel slidably retains the fastener apparatus for tightening the body to the upright standard. A first end of the cylindrical body has a flange end having an oval neck portion with chordal sides for receiving a clothes hanger's hook member. A dovetail aperture is disposed in the first end. The dovetail aperture has an opening at the center of the channel and has an adjacent cavity. The cavity can retain a spherical member of a special hanger. The fastener apparatus includes an elongated fastener member having a first end with a bolt-combination disposed proximal to the first end of the cylindrical body, and a second end with a hook member proximal to a second end of the cylindrical body.

10 Claims, 3 Drawing Sheets

DETACHABLE PERSONAL ACCESSORY APPARATUS FOR USE WITH PANEL SYSTEMS

FIELD OF THE INVENTION

The subject invention relates generally to modular wall panel systems and, more particularly, to a demountable apparatus for removably suspending desired personal accessories.

BACKGROUND OF THE INVENTION

Modular wall panel systems are used in the partitioning of office building interiors. These partitioned sections are commonly referred to as "work stations." Persons who occupy the work stations during their working day need to store personal items, such as a coat, in a way that will not clutter the work station.

There are a number of prior art coat hanger holders which are referred to as "costumers" by those skilled in the art. Examples are shown in FIGS. 1*a* and 1*b*.

A first example 5 of a costumer (shown in FIG. 1*a*) is essentially a flat mounting plate 10 or panel having one or more cylindrical accessory holders 12 permanently affixed. The cylindrical accessory holders 12 used with costumers may have an enlarged end plate 14 affixed thereto to prevent a coat hanger's 16 hook member 17 from sliding off of the end.

A disadvantage of existing plate costumers 5 is that the personal accessory holders 12 must first be affixed to the mounting plate 10, and then the mounting plate 10 is affixed to a wall panel 20 or door using screws 24. The mounting plate 10 often has a wood grain or other surface texture that is different from the fabric texture of the wall panel 20, and may be unpleasant to the eye. Personal accessory holders 12 are usually affixed to the mounting plate 10 using a predetermined mounting pattern that may further be undesirable for the user.

A second example 7 of a costumer (shown in FIG. 1*b*) may include an elongated U-shaped mounting plate 18 that is adapted to be placed over the topmost portion of the modular wall panel 20 with elongated sides 22 extending down either side of the modular wall panel 20. The end of either elongated side has accessory holders 12 permanently affixed.

A disadvantage of the elongated U-shaped costumers 7 is that they are manufactured in fixed lengths that prevent users from obtaining an exact vertical placement or vertical alteration of the accessory holder's 12 position. Another problem with these costumers is that the color may be different from the modular wall panel. Thus, the U-shaped costumers 7 appear to be afterthoughts of panel system work stations and may be unappealing to the eye.

Furthermore, if a force is applied to the underside of a personal accessory holder 12, the U-shaped costumer 7 may be dislodged from the modular wall panel 20 and cause harm.

OBJECTS OF THE INVENTION

There exists a need for a personal accessory holder that may be affixed to a modular wall panel without using a supplemental fastening apparatus, thereby substantially inhibiting accidental removal.

It is therefore an object of the present invention to provide an improved personal accessory fastener for use with modular wall panel systems;

It is another object of the present invention to provide a personal accessory holder that demountably couples to existing modular wall panel shelving apparatus;

It is still another object of the invention to provide a personal accessory holder that inhibits removal thereof from shelving apparatus; and It is yet a further object of the invention to provide a personal accessory holder that is adapted to be used by personal accessory hangers having various configurations.

SUMMARY OF THE INVENTION

These and other objects and advantages of the present invention are achieved by providing a personal accessory holder adapted to be demountably affixed to an existing personal accessory standard.

The personal accessory holder of the preferred embodiment has an elongated cylindrical body with an adjustable fastening means for mounting the personal accessory holder to the accessory standard. A channel through the cylindrical body slidably retains the fastening means, allowing the fastening means to be tightened onto the standard.

A first end of the cylindrical body has a flange end with an oval neck. The neck accepts a clothes hanger's hook member to be hung in place.

The first end also has a dovetail aperture with an opening leading to the channel, and an adjacent cavity. A spherical member of a special hanger may be retained in the cavity.

BRIEF DESCRIPTION OF THE DRAWINGS

The present invention, both as to its organization and manner of operation, together with further objects and advantages, may be understood by reference to the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in these arts, since the generic principles of the present invention have been defined herein.

Figure 1A:
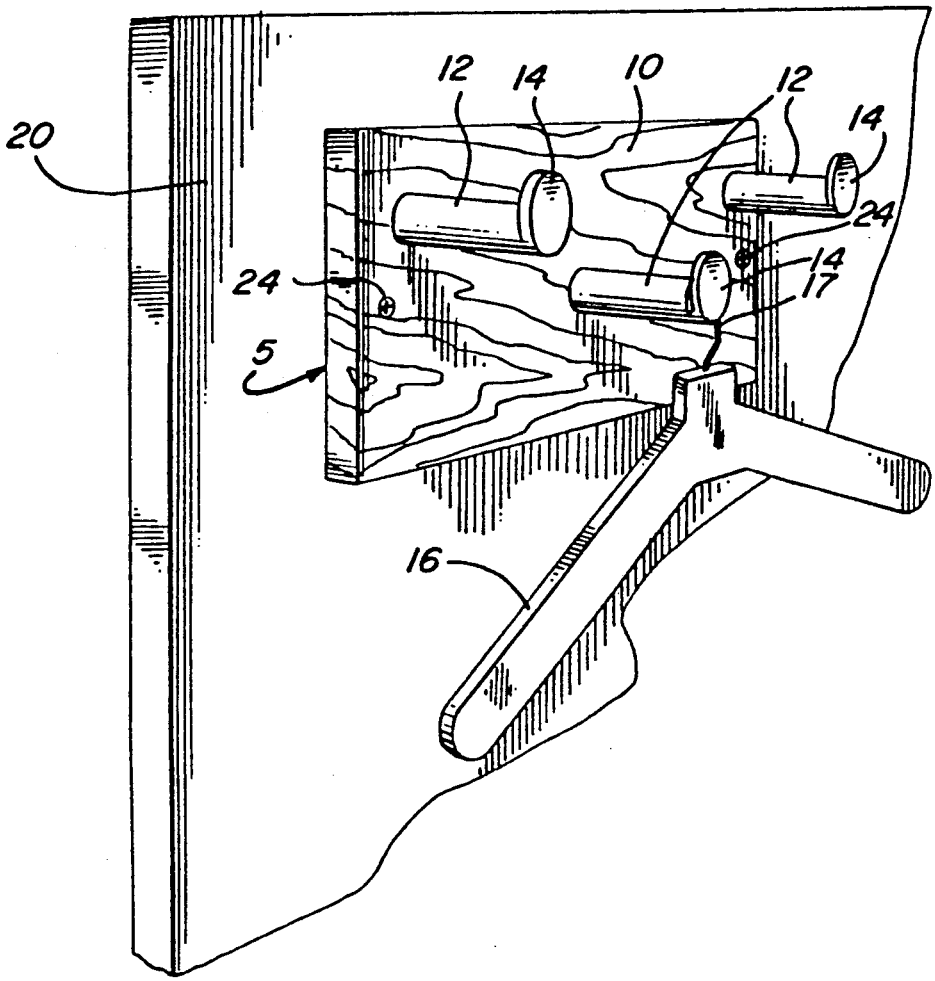
FIG. 1a PRIOR ART
FIG. 1*a* is a perspective view of a first example of a prior art costumer.
Figure 1B:
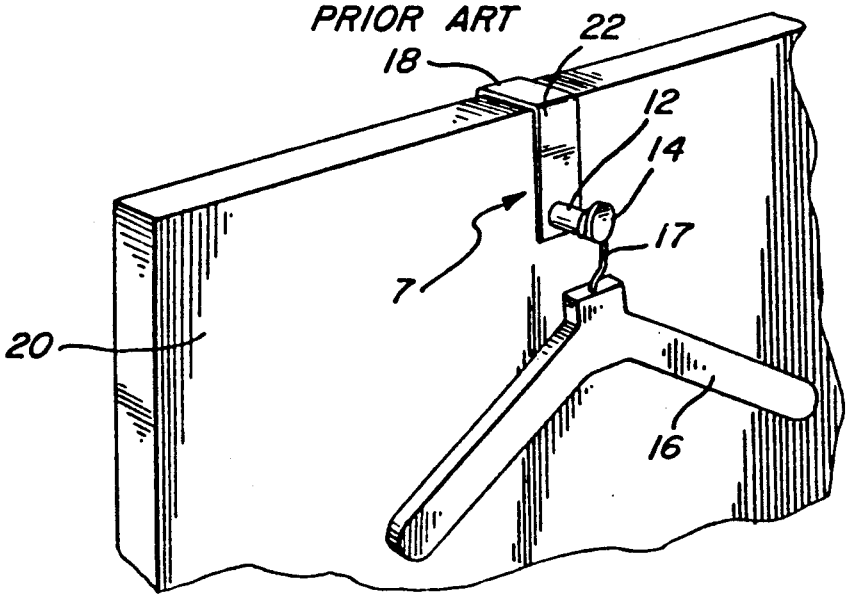
FIG. 1b PRIOR ART
FIG. 1*b* is a perspective view of a second example of a prior art consumer.
Figure 2:
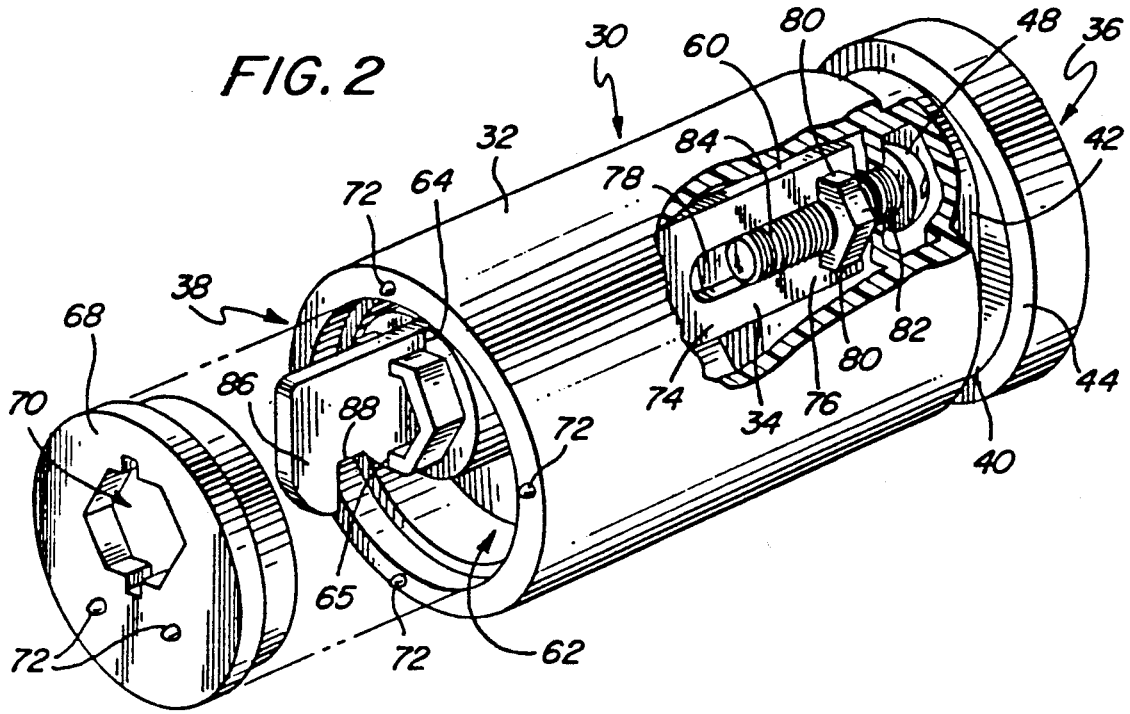
FIG. 2 is a partially cutaway perspective view of a preferred embodiment of a personal accessory holder according to the present invention.
Figure 3:
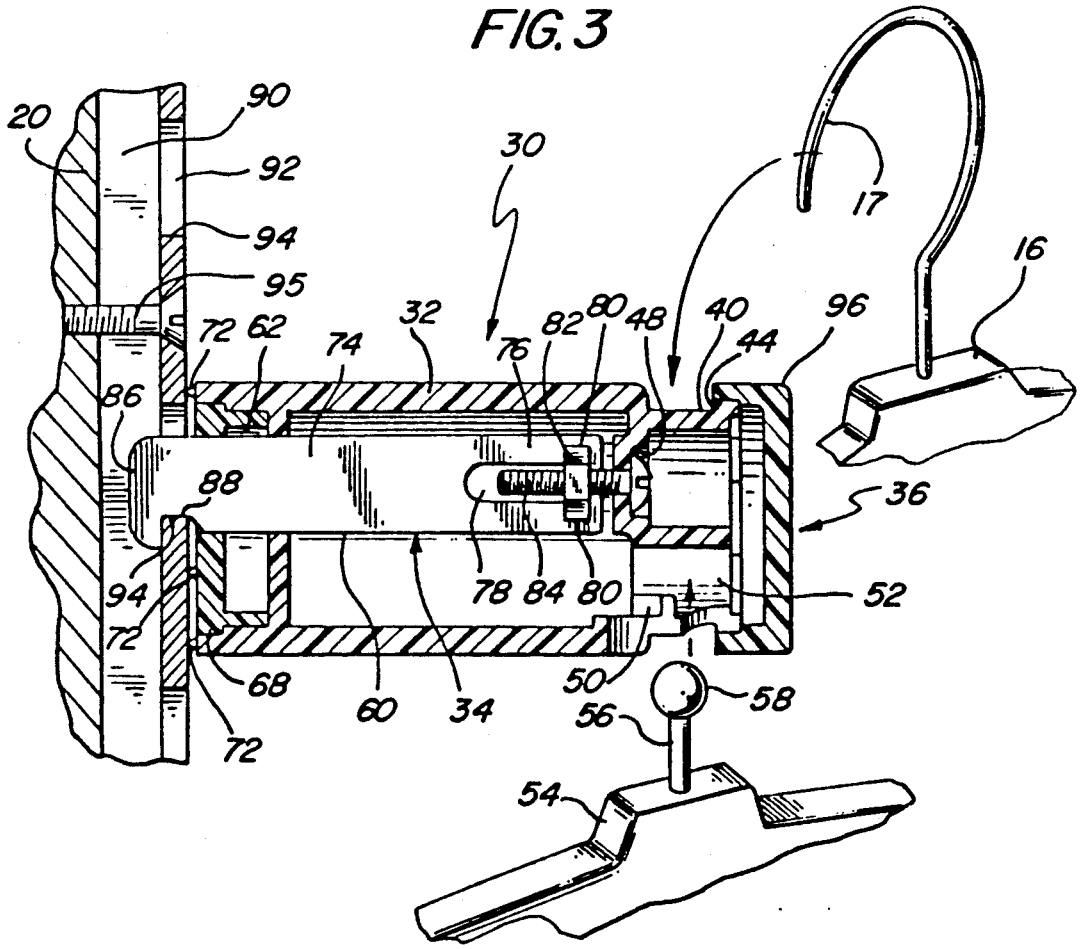
FIG. 3 is a cross-sectional view showing the preferred embodiment affixed to a slotted accessory standard.

FIGS. 2 and 3 show a personal accessory holder 30, constructed according to the preferred embodiment of the present invention. The personal accessory holder 30 includes an elongated cylindrical body 32 and an adjustable fastening means 34. In the preferred embodiment 30, the cylindrical body 32 may include any suitable triple copolymer plastic, such as acryl butyl styrene (ABS) plastic. The cylindrical body 32 has a first end 36 and a second end 38.

The first end 36 includes a substantially oval neck portion 40 having chordal sides 42. A circular end flange 44 is located on the outer periphery of the neck portion 40. The first end 36 has a dovetail aperture 46 disposed within the flange 44 (shown in FIG. 4) wherein a circular opening 48 is located.

A cavity 50, having a beveled concave configuration, is disposed directly below the circular opening 48 and at the innermost portion of the dovetail aperture 46. An elongated channel 52 extends from the flange 44 to the bottom of the concave cavity 50, along the longitudinal axis of the body member 32. The channel 52 and cavity 50 may be adapted to accommodate an alternative coat hanger 54. The coat hanger 54 has a rod member 56 that attaches a spherical member 55 to the hanger 54.

A substantially elongated hexagonal channel 60 extends through the topmost portion of the cylindrical body 32. The channel 60 runs generally parallel to the longitudinal axis of the cylindrical body 32. The channel 60 begins flush with the outermost portion of the second end 38, extends through recess 62, terminating at the circular opening 48. The hexagonal channel 60 has a top groove 64 extending along the length of the channel 60. A bottom groove 65 also extends the length of the channel 60, diametrically opposed to the top groove 64.

The recess 62 in the second end 38 is adapted to retain a second end cap 68. The second end cap 38 has a hexagonal opening 70 for leading to the hexagonal channel 60 when placed in the recess 62. The end cap 68 also includes a pair of protrusions 72 located adjacent and parallel to a bottom-most side of the hexagonal opening 70. The second end 38 may also have a plurality of protrusions 72 spatially positioned about the outer periphery.

The fastener means 34 includes a substantially flat elongated fastener plate 74 adapted to be slidably retained in the hexagonal channel 60. The top groove 64 and bottom groove 65 secure the fastener plate 74 in a plane substantially parallel to the longitudinal axis of the cylindrical body 32. The fastener plate 74 includes a first end portion 76 having a substantially elongated U-shaped slot 78.

A pair of notches 80 are disposed through the slot's 78 inner periphery where a nut 82, for example, may be integrally affixed. An adjustable member 84, such as a bolt, is disposed through the circular opening 48 in the first end 36 and is adapted to be adjustably retained in the threaded nut 82. The length of the fastening means 34 may be increased or decreased by first coupling the bolt 84 with the nut 82, then rotating the bolt 84 in a desired direction to either reduce or increase the length of the fastening means 34.

The fastener plate 74 has a second end portion configured as a hook member 86. The hook member 86 is substantially rounded and has a notch 88 for forming the hook member 86.

The personal accessory holder 30 may be demountably affixed to a slotted accessory standard 90. The slotted standard 90 is affixed to a desired modular wall panel 20 using screws 95, and has a plurality of slots 92 for receiving the hook member 86 of the fastener plate 74.

The personal accessory holder 30 is affixed to the slotted standard 90 by first adjusting the fastening means 74 to its maximum length, by rotating the bolt 84 counterclockwise until only the end portion resides in the nut 82. This increases the length of the fastening means 34, resulting with a substantial amount of the fastener plate 74 extending outward from the cylindrical body's second end 38. The hook member 86 is then disposed through the desired opening 92 in the slotted upright 90, until the notch 88 is in alignment with an opening's bottom edge 94. The bottom edge 94 is adapted to fit in the notch 88, when the hook member 86 is aligned.

The fastener plate 74 is secured to the slotted upright 90 by lowering the hook member's 86 notch 88 over the bottom edge 94 of the desired opening 92, inducing the hook member 86 to engage the slotted standard 90. The bolt 84 is rotated clockwise to reduce the length of the fastening means 34. The bolt 84 is further rotated clockwise until the second end 38 is tight against the slotted standard 90. This procedure secures the personal accessory holder 30 to the desired slotted standard 90 and inhibits removal therefrom.

Figure 4:
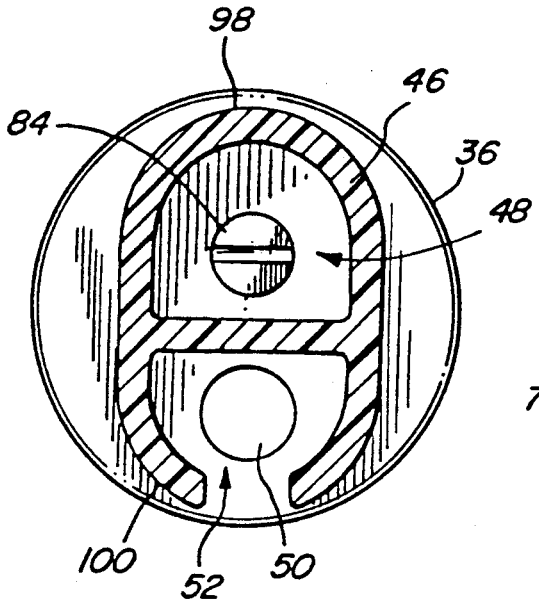
FIG. 4 is a plan view of a first end of the preferred embodiment.

FIG. 4 shows the cylindrical body's 32 first end 36. The dovetail aperture 46 is shown having a top portion 98 and a bottom portion 100. The bolt 84 is disposed through the circular opening 48. The circular opening 48 has a diameter substantially larger than the bolt 84, and large enough to accommodate a given tool, such as a screwdriver for example, for rotating the bolt 84.

The concave cavity 50 is disposed below and adjacent the circular opening 48 in the dovetail aperture's 46 bottom portion 100. The concave cavity 50 will retain an alternative hanger's 54 spherical member 58. The channel 52 allows a rod member 56 affixed to the spherical member 58 to pass when placing the spherical member 58 in the cavity 50.

Figure 5:
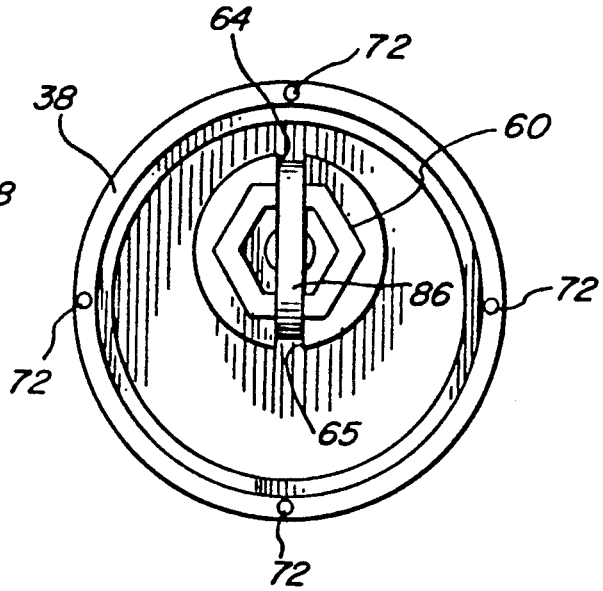
FIG. 5 is a plan view showing a second end of the preferred embodiment of the present invention.

FIG. 5 shows the cylindrical body's 32 second end 38. The hexagonal channel 60 is disposed at a topmost portion of the second end 38. The top groove 64 and bottom groove 65 each extend the length of the channel 60 and are adapted to retain the substantially flat, elongated fastener plate 74 in a plane parallel to the longitudinal axis of the cylindrical body 32. The protrusions 72 that prevent relative slippage of the cylindrical body member 32 to the slotted standard 90 are shown affixed to the outer periphery of the second end portion 38.

Figure 6:
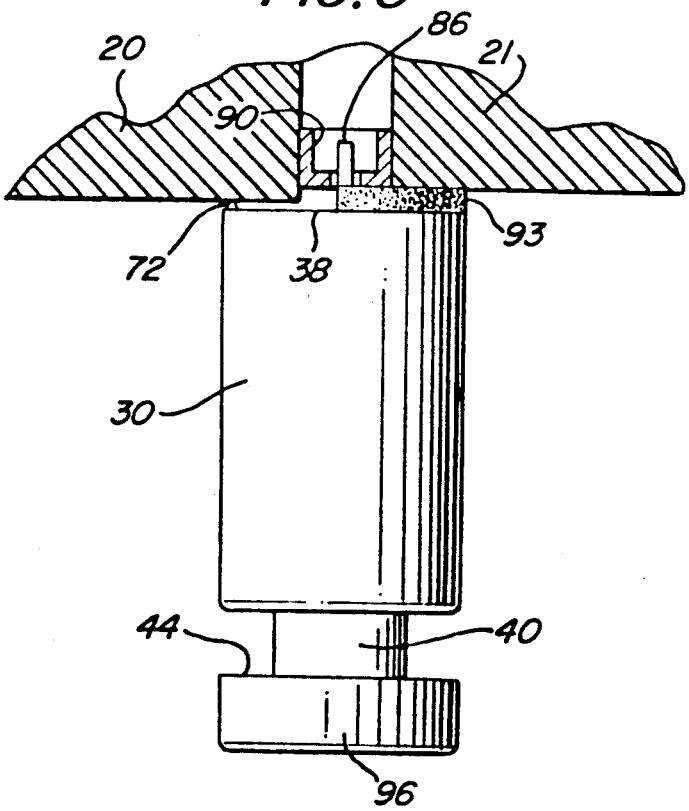
FIG. 6 is a top view showing the present invention attached to a slotted accessory standard interposed between two wall panels.
Figure 7:
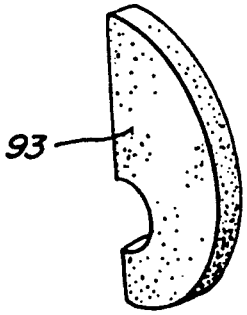
FIG. 7 is a perspective view of a spacer used with the present invention.

Referring now to FIGS. 6 and 7, the slotted standard 90 may be mounted flush with the modular wall panel 20, or may be interposed between two wall panels 20, 21. If the wall panels 20, 21 are not substantially flush, a filler 93 may be placed between a portion of the accessory holder's second end 38 and the wall panel 21 for preventing the accessory holder from skewing while being tightened and when installed. The filler 93 may be substantially C-shaped and comprised of any suitable flexible, shore strength, hard rubber.

When the cylindrical body 32 is being tightened against the standard 90, there may be lateral rotation between the standard 90 and cylindrical body 32. The protrusions 72 disposed on the outer periphery of the second end 38 and the second end cap 68 project into the fabric wall panel 20, as the cylindrical body 32 is being tightened against the wall panel 20 and slotted standard 90. The protrusions 72 limit the lateral rotation of the cylindrical body 32 relative to the wall panel 20 and slotted standard 90, and ease installation of the accessory holder 30.

A hook member 17 of a conventional coat hanger 16 may be placed over the neck portion 40 to suspend a desired personal accessory. The alternative hanger 54 having the spherical member 58 may be placed into the dovetail aperture 46 and passed through the channel 52 to reside in the concave cavity 50 for retaining the spherical member 58. A circular end cap 96 may be secured to the flange 44 for enhancing the outward appearance of the personal accessory holder 30 without interfering with the hanger 16 or 54 disposed over the neck portion 40 or residing in the concave cavity 50.

While the above features of the preferred embodiment of the present invention teach the general features of the invention, it can be readily appreciated that it would be possible to deviate from the above embodiments of the present invention and, as will be readily understood by those skilled in the art, the invention is capable of many modifications and improvements within the scope and spirit thereof. Accordingly, it should be understood that the invention is not to be limited by the specific embodiments but only by the spirit and scope of the appended claims.

What is claimed is:

1. A demountable apparatus for use with panel systems comprising:

a body member having a channel; and an adjustable fastener member located in said channel, said fastener member including a first end comprising a length adjusting mechanism and a second end comprising a hook member, said body member comprising an elongated cylinder having a first end including an opening for receiving a threaded bolt, said channel including a pair of diametrically opposed grooves, said channel terminating in the opening in said first end of said body, and wherein said fastener member comprises a flat elongated fastener plate slidably retained in the grooves of said channel, said fastener plate including a first end located proximal the first end of said body, said first end including means for holding a nut, and having a second end located proximal a second end of said body comprising a hook member made integral with said fastener plate, said fastener plate receiving the threaded bolt disposed through the opening of the first end of said body, said bolt adjustably retained in the nut of said fastener plate.

2. The demountable apparatus of claim 1, wherein said nut is integrally formed with said fastener plate.

3. The demountable apparatus of claim 1, wherein said fastener plate includes a longitudinal slot extending from said first end of said plate toward said second end, said slot for receiving a portion of the bolt extending through said nut.

4. The demountable apparatus of claim 3, wherein said fastener plate includes a pair of notches formed adjacent said slot for holding said nut perpendicular to said slot.

5. The demountable apparatus of claim 1, wherein said nut is a hexagonal nut and said channel has a hexagonal cross-section for closely receiving said hexagonal nut.

6. A demountable apparatus for use with upright slotted wall standards comprising:

body means for attaching a desired accessory thereto; and adjustable fastener means for detachably mounting said body means to an upright slotted wall standard, and wherein said body means comprises an elongated cylindrical body member having two ends, a first end thereof having a neck portion for receiving a hook member of a conventional clothes hanger and having a aperture disposed therein, said aperture having a cavity for receiving a spherical member of an alternative clothes hanger, a second end of said body having a channel disposed therethrough parallel to the longitudinal axis thereof, said channel having a pair of diametrically opposing grooves, said channel terminating in a opening in the first end of said body.

7. The demountable apparatus of claim 6, wherein said cavity extends into said neck portion and said neck portion includes a slot formed along a bottom portion thereof, said slot of said neck portion extending from said first end of said body member toward said second end along said cavity.

8. The demountable apparatus of claim 6, wherein a cap is provided for detachably mounting over the cavity and opening of the aperture.

9. A demountable apparatus for use with upright slotted wall standard comprising:

body means for attaching a desired accessory thereto; and adjustable fastener means for detachably mounting said body means to an upright slotted wall standard, and wherein said fastener means further comprises a flat elongated fastener plate slidably retained in the pair of grooves, said fastener plate having a first end located proximal said first end of said body having a slot for receiving a nut, and having a second end located proximal the second end of said body comprising a hook member made integral with said fastener plate, said fastener means having a threaded bolt disposed through the opening of said cylindrical body and adjustably retained in the nut of said fastener plate.

10. A detachable, apparatus having an adjustable fastening means for use with slotted standards used in modular wall panel systems, said apparatus comprising:

an elongated, cylindrical body member having two ends, a first end thereof having a substantially oval configuration having chordal sides and having a circular flange on the outer periphery thereof, said first end having a dovetail aperture having a substantially circular opening disposed therethrough and having a circular cavity of a diameter substantially less than the circular opening disposed adjacent thereto, a second end of said cylindrical body member having a substantially hexagonal channel disposed therethrough parallel to the longitudinal axis thereof and about the centroid of said circular opening, said hexagonal channel having a top groove disposed in a top side thereof and a bottom groove disposed in a bottom side thereof, said channel terminating in the circular opening in said first end of said cylindrical body member;

a substantially flat, elongated, adjustable metallic fastener plate slidably retained in the top groove and in the bottom groove of said hexagonal channel, said fastener plate having a first end having a threaded nut member made integral therewith, and having a second end comprising a hook member made integral with said fastener plate; and a threaded bolt member adapted to be disposed through the circular opening in the first end of said cylindrical body member and to be adjustably retained on the nut member of said fastener plate.

* * * * *